US005950046A

United States Patent [19]

Goto

[11] Patent Number: 5,950,046

[45] Date of Patent: Sep. 7, 1999

[54] ELECTROPHOTOGRAPHIC APPARATUS HAVING A MODULE FIXING MEMBER

[75] Inventor: Shinji Goto, Mishima, Japan

[73] Assignee: Canon Kabushiki Kaisha, Tokyo, Japan

[21] Appl. No.: 09/027,566

[22] Filed: Feb. 23, 1998

[30] Foreign Application Priority Data

Feb. 26, 1997 [JP] Japan ..... 9-041903

[51] Int. Cl.[6] ..... G03G 15/00; G03G 21/16

[52] U.S. Cl. ..... 399/110; 347/138

[58] Field of Search ..... 397/90, 107, 110; 347/138, 152, 263; 358/296, 401

[56] References Cited

U.S. PATENT DOCUMENTS

| | | | |
|---|---|---|---|
| 4,798,373 | 1/1989 | Hyltoft | 271/9.05 |
| 5,758,249 | 5/1998 | Dutton et al. | 399/391 |
| 5,850,581 | 12/1998 | Roller | 399/2 |

FOREIGN PATENT DOCUMENTS 4-19175 1/1992 Japan .

*Primary Examiner*—Joan Pendegrass
*Attorney, Agent, or Firm*—Fitzpatrick, Cella, Harper & Scinto

[57] ABSTRACT

A module connecting mechanism of an electrophotographic apparatus includes an engine module having an electrophotographic process section, a supplying module for supplying a transfer sheet to the electrophotographic process section, and a conductive module connecting mechanism for connecting an installation section of the supplying module with an installation section of the engine module electrically. A common plane extending substantially in parallel with the direction of connecting the supplying module with the engine module is formed over the supplying module and the engine module in order to connect the supplying module and the engine module at the installation portions electrically, wherein the engine module is superposed on the supplying module.

7 Claims, 4 Drawing Sheets

ELECTROPHOTOGRAPHIC APPARATUS HAVING A MODULE FIXING MEMBER

BACKGROUND OF THE INVENTION

1. Field of the Invention

The present invention relates particularly to a module connecting mechanism for an electrophotograhic apparatus having a configuration in which a supplying module is separated from an engine module in a vertical direction.

2. Related Background Art

Conventionally, there has been used a laser beam printer (LBP) as a printer having an electrophotographic system, The variety of demands in regard to its use as the laser beam printer has spread, such as a demand for diversification of a supplying cassette. In other words, there is a demand for a laser beam printer having a configuration which satisfies not only a need of a user who wants to use a standard cassette having a large capacity, but also a need of another user who wants to use various cassettes even if each cassette has a small capacity. Accordingly in order to satisfy these demands, there is a growing tendency for printers to have a configuration in which each printer is divided into two types of modules, an engine module and a supplying module, so that a single engine module can be connected to several types of supplying modules.

In order to satisfy the needs of the market quickly, the above modules are independently delivered with exterior fittings, and then after being connected and packed in the nearest place to a customer, they are delivered again as a printer. The modules are connected to each other only by fastening with screws at the bottom of the printer or by mounting the engine module.

In the conventional configuration, however, the engine module has been connected to the supplying module only in the vertical direction. Therefore, there has been a problem that the modules may be disconnected or that the printer is deformed when a shock is applied to the engine module or the supplying module in a direction perpendicular to the connection during transportation after the connection is completed, due to a strong force applied in a direction of shifting a relative position of the supplying module to the engine module. In addition, if such a disconnection or a deformation of the device occurs, it may lead to a sheet jam or a degradation of the image quality. Therefore, it is required to improve these laser beam printers which need to have high reliability and high image quality.

SUMMARY OF THE INVENTION

It is an object of the present invention to provide a module connecting mechanism of an electrophotographic apparatus which reinforces a connection of a supplying module and an engine module, and ensures a relative position between these modules.

The present invention which accomplishes the above object, in a module connecting mechanism of an electrophotographic apparatus, comprises an engine module having an electrophotographic process section; a supplying module for supplying a transfer sheet to the electrophotographic process section of the engine module; and a conductive module connecting mechanism for connecting an installation section of the supplying module with an installation section of the engine module electrically. A common plane extending substantially in parallel with the direction of connecting the supplying module with the engine module is formed over the supplying module and the engine module in order to connect the supplying module and the engine module at the installation portions electrically, with the engine module being superposed on the supplying module.

DETAILED DESCRIPTION OF THE PREFERRED EMBODIMENTS

Preferred embodiments of the present invention will be described below by using the accompanying drawings.

Figure 1:
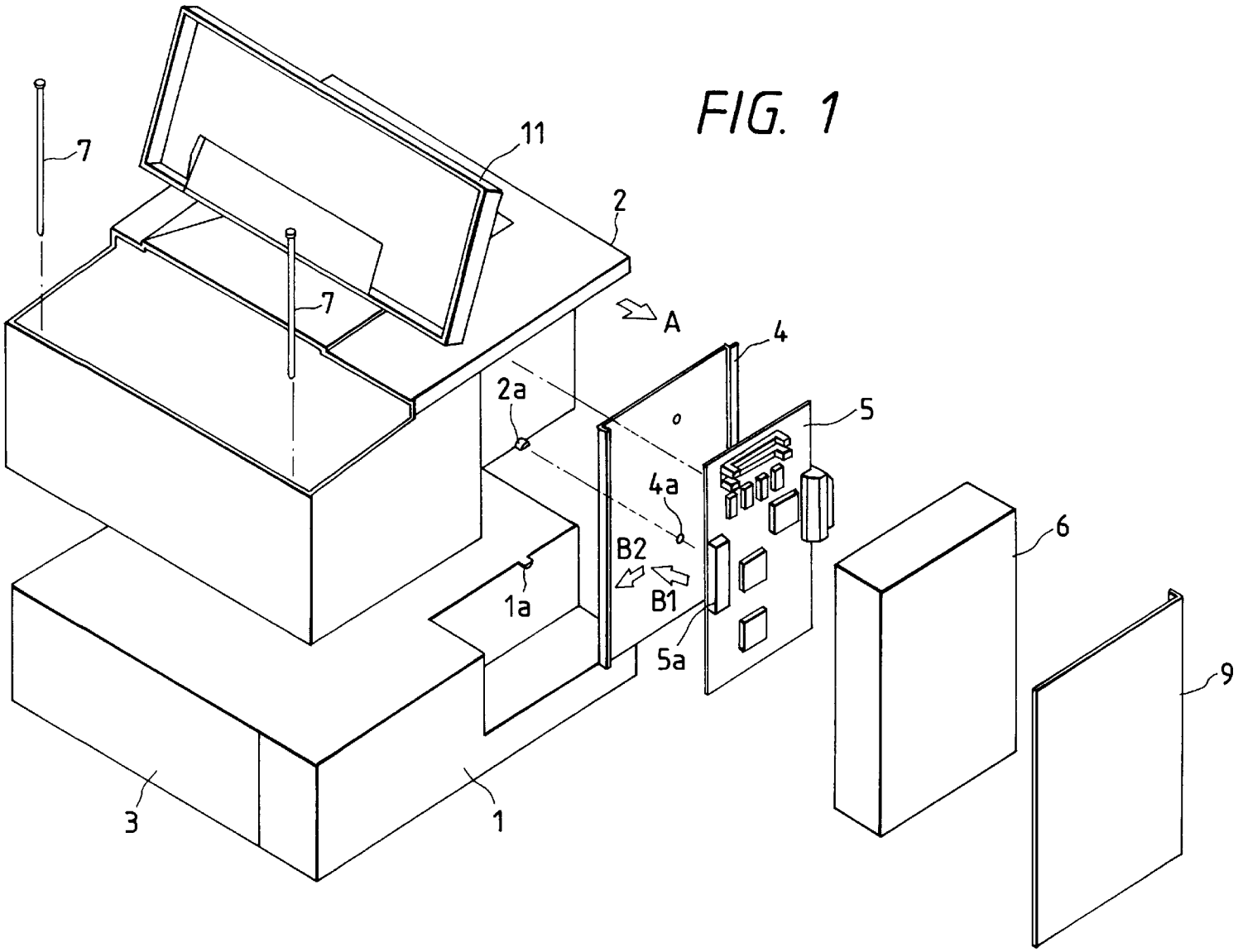
FIG. 1 is an exploded perspective view illustrating a module connecting mechanism according to the present invention.

Referring to FIG. 1, reference numeral 1 indicates a supplying module 1 while reference numeral 2 indicates an engine module 2. The engine module 2 is used to print data on a sheet supplied by the, supplying module 1 in an electrophotographic process of a laser beam printer and then to eject the sheet. In addition, there are shown a supplying cassette 3, a connecting sheet metal 4, an image controller board 5 for converting image information transmitted from a computer (not shown) to laser signals, a shield case 6, and a shield cover 9.

The supplying module 1 and the engine module 2 will be described below referring to FIG. 2. Sheets stacked in the supplying cassette 3 are sequentially fed from the highest one by a pickup roller 12, separated from each other by a pair of retard rollers consisting of a supply roller 13 and a retard roller 14, and then conveyed. The supply roller 13 is driven to be rotated in a sheet conveying direction, while the retard roller 14 is driven to be rotated in a direction opposite to the sheet conveying direction via a torque limiter (not shown) having a predetermined torque value. Furthermore, in the supplying module 1, there are arranged a supplying driving system and a clutch mechanism (not shown) for transmitting a driving force supplied from the main frame and for driving intermittently the rotation of the pickup roller 12, the supply roller 13, and the retard roller 14, a means for detecting the clutch mechanism or a cassette size, a means for detecting whether no sheet remains, and a substrate (not shown) used for operating other electrical parts.

On the other hand, in the engine module 2, there are arranged a conveying roller 21 for conveying sheets delivered from the supplying module 1 and a registration roller 22 for putting the tips of the sheets even, so that the sheets are guided to a transferring section 23 by these two rollers 21 and 22.

In this manner, image information which has been transferred from the host computer becomes ON/OFF information of a laser in the image controller board 5 and it is transmitted to a laser scanner 25 via an engine controller 24, and then a photosensitive drum 26 is irradiated with a laser beam, by which a latent image is formed on the photosensitive drum 26. This latent image is visualized as a developed image in a developing process, and the developed image is transferred onto a sheet in the transferring section 23. The developed image transferred to the sheet is fixed on the sheet in a fixing section 27, and then the sheet which completes the fixing of the developed image is discharged to a sheet output section 28 with its image surface facing downward.

Figure 2:
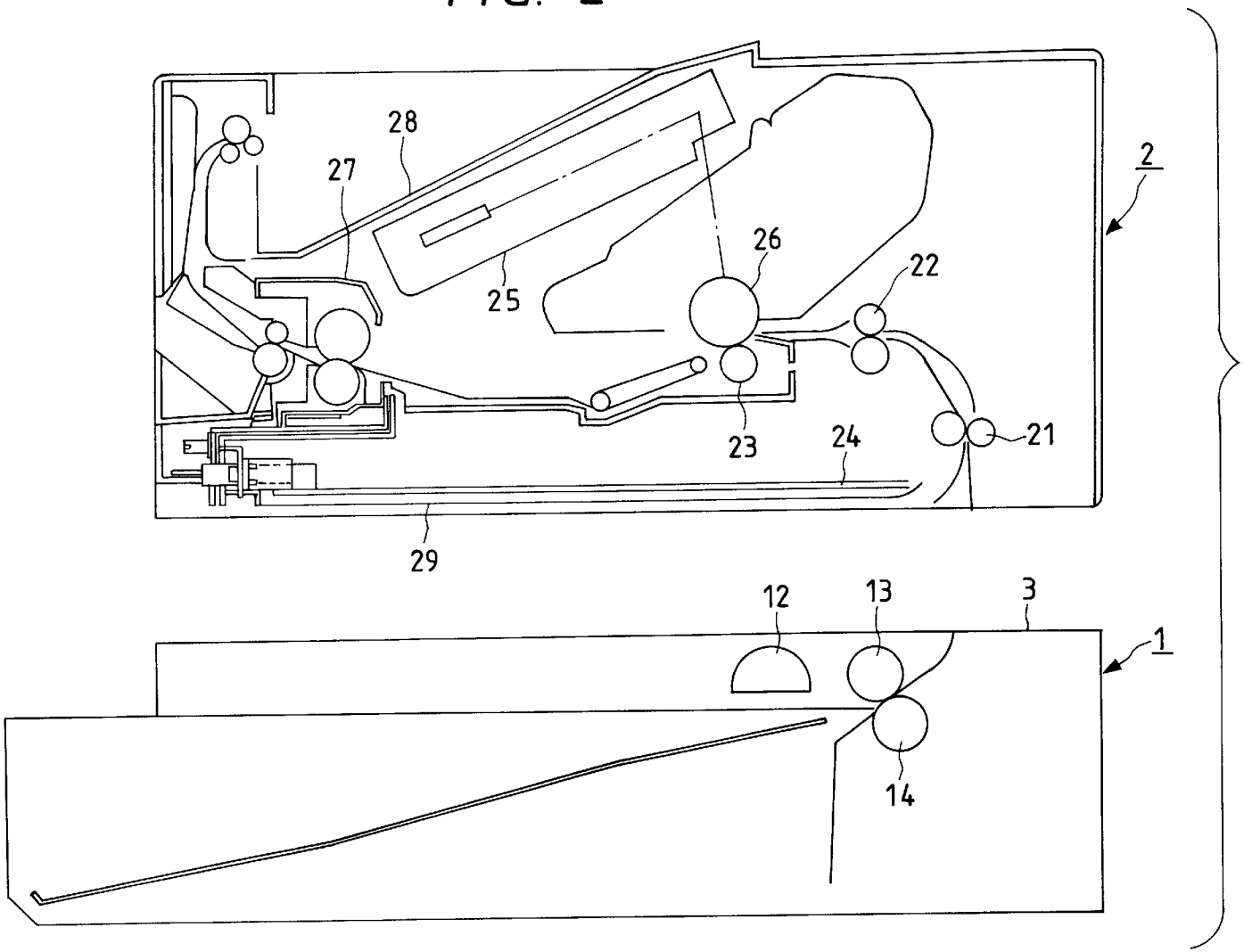
FIG. 2 is a section view of a laser beam printer having the module connecting mechanism according to the present invention.

As apparent from FIG. 2, the engine controller 24 is arranged under a sheet conveying path in the engine module 2. The engine controller 24 has an AC power supply for supplying power to a fixing heater, a DC low-voltage power supply for supplying power to drive a motor and to an electric signal system, a high-voltage power supply used for the electrophotographic process, control functions for these, a function of transmitting or receiving signals to or from the supplying module, and a function of communicating with an image controller board 5. Additionally, under the engine controller 24, there is arranged a shield plate 29 used for protecting the engine controller 24 from a shock caused by vibrations or by being dropped during transportation of the engine module 2 or front static electricity generated by a serviceman in treating a single engine module 2.

As described above, with collecting all parts related to electrophotography in the engine module 2, electrophotographic operations in regard to the engine module 2 can be checked independently of the check of a supplying mechanism in regard to the supplying module, if the engine module 2 is delivered independently of the supplying module 1. Specifically, in regard to the engine module 2, functions of the electrophotographic apparatus such as an image of the engine module 2 and a curl can be checked in a production line by simply connecting a jig supplying unit for supplying sheets and a jig controller for supplying driving signals of the laser to the engine module 2.

On the other hand, in regard to the supplying module 1, functions of the supplying module 1 such as supplying properties (double-supplying, poor or bad supplying) and convey properties (skew-supplying) can be checked in the production line by connecting a jig driving source for supplying a driving force and a control jig for supplying signals to the supplying module 1. Therefore, it becomes possible to produce the engine module 2 and the supplying module 1 in independent production lines and then to ensure their qualities, whereby a higher degree of freedom is obtained related to setting of producing districts of the engine module 2 and the supplying module 1.

In addition, the engine module 2 can be connected to several different supplying modules 1. For example, it is possible to provide a model equipped with two 250-sheet cassettes or with a single 500-sheet cassette, or to deal with or adjust the types of cassettes which are adapted to an area where the cassettes are sold or adapted to needs of a user. Furthermore, the engine module 2 can be easily connected to the supplying module 1, and therefore if the engine module 2 and the supplying module 1 are separately stored in places near an area where they are to be sold (for example, dealers), it is possible to satisfy the needs of a user immediately.

Accordingly, to connect the supplying module 1 to the engine module 2, the engine module 2 is mounted from an upper position of the supplying module 1 and then a connecting sheet metal 4 is fitted from their side direction. In this case, a shaft 2*a* protruding from the engine module 2 and a shaft 1*a* protruding from the supplying module 1 are arranged in a positional relationship that they match and form a cylindrical shaft when the supplying module 1 is connected to the engine module 2, and the upper surface of the shaft 2*a* protruding from the engine module 2 and the lower surface of the shaft 1*a* protruding from the supplying module 1 are fitted into a hole 4*a* formed on the connecting sheet metal 4 in a state that the supplying module 1 is connected to the engine module 2.

Therefore, by fitting the connecting sheet metal 4 from the side direction, the engine module 2 and the supplying module 1 are fastened in a vertical. direction. In this state, the modules are to be fastened with screws on the side surface. Conventionally in tightening the screws, it has been required to hold the engine module 2 while tightening the screws so as to prevent the engine module 2 from rising. In this embodiment, however, the engine module 2 and the supplying module 1 are fastened in a vertical direction as described above, and therefore it does not need to hold the engine module 2 on its top while tightening the screws. Although the shaft 2*a* and the shaft 1*a* have shapes which form a cylindrical shape when the supplying module 1 is connected to the engine module in this embodiment, the shape to be formed is not limited to the cylindrical one since the primary object of the shaft 2*a* and the shaft 1*a* is to fasten the engine module 2 and the supplying module 1 in a vertical direction.

While the connecting sheet metal 4 is fitted on the engine module 2 and the supplying module 1 with the screws, one of the screws used for the engine module 2 is put on a sheet metal of a safety ground or a frame ground. Preferably this sheet metal is grounded from an AC inlet ground terminal directly to earth or ground or it is directly grounded to the engine from outside, so as to obtain reliable grounding.

One of the screws used for the supplying module 1 is put on a sheet metal member, so as to ground the entire supplying module 1 via the sheet metal member. Preferably the connecting sheet metal 4 is fitted with at least four screws, preferably five or more screws (or with other connecting means) in order to inhibit a deformation of the engine module 2 and the supplying module 1 in a direction indicated by an arrow A as shown in FIG. 1.

The connecting sheet metal 4 electrically shields an image controller board 5 for converting image signals transmitted from the host computer to control signals of the laser of the engine in cooperation with a shield case 6. The image controller board 5 is previously fitted on the shield case 6 as a unit, which is installed into the device in a form of a shield case unit by being inserted in a direction indicated by an arrow B1 in FIG. 1 first and then in a direction indicated by an arrow B2. In the engine side, there is arranged a floating connector (not shown) connected to an engine controller 24 (see FIG. 2) through wiring, and the floating connector is connected to a connector 5*a* on the image controller board 5 with a motion in the direction indicated by the arrow B2. Naturally the engine controller 24 can be electrically connected to the image controller 5 by connecting directly the connectors on each substrate with each other.

The above shield case 6 is fitted on the connecting sheet metal 4 with screws, by which a shield is completed so as to be used for protecting the image controller from noises generated by the image controller board 5 and from external electrical noises.

The image controller board 5 can satisfy needs of a user or a dealer such as a capacity of a memory which is mounted, a language used for a display, or the like in the same manner as for the supplying module 1. Therefore, it is preferable to apply the configuration of the present invention in which the image controller board 5 can be built in as well as the engine module 2 can be connected to the supplying module 1.

As set forth hereinabove, with an application of the configuration in which the image controller board 5 is fitted after the engine module 2 is connected to the supplying module 1, a large fitting area of the image controller board 5 can be reserved since the area can be laid across the connection of the engine module 2 and the supplying module 1 while the engine module 2 and the supplying module 1 are independently assembled. At this point, by setting the fitting area of the image controller board 5 within the area of the supplying module 1 which is the smallest one, it becomes possible to use the same image controller board 5 for all the supplying modules 2.

After assembling the shield case 6, a shield cover 9 is fitted. The shield cover 9 can be easily removed by a user on its configuration, whereby the user can easily add memories in the image controller.

Figure 3:
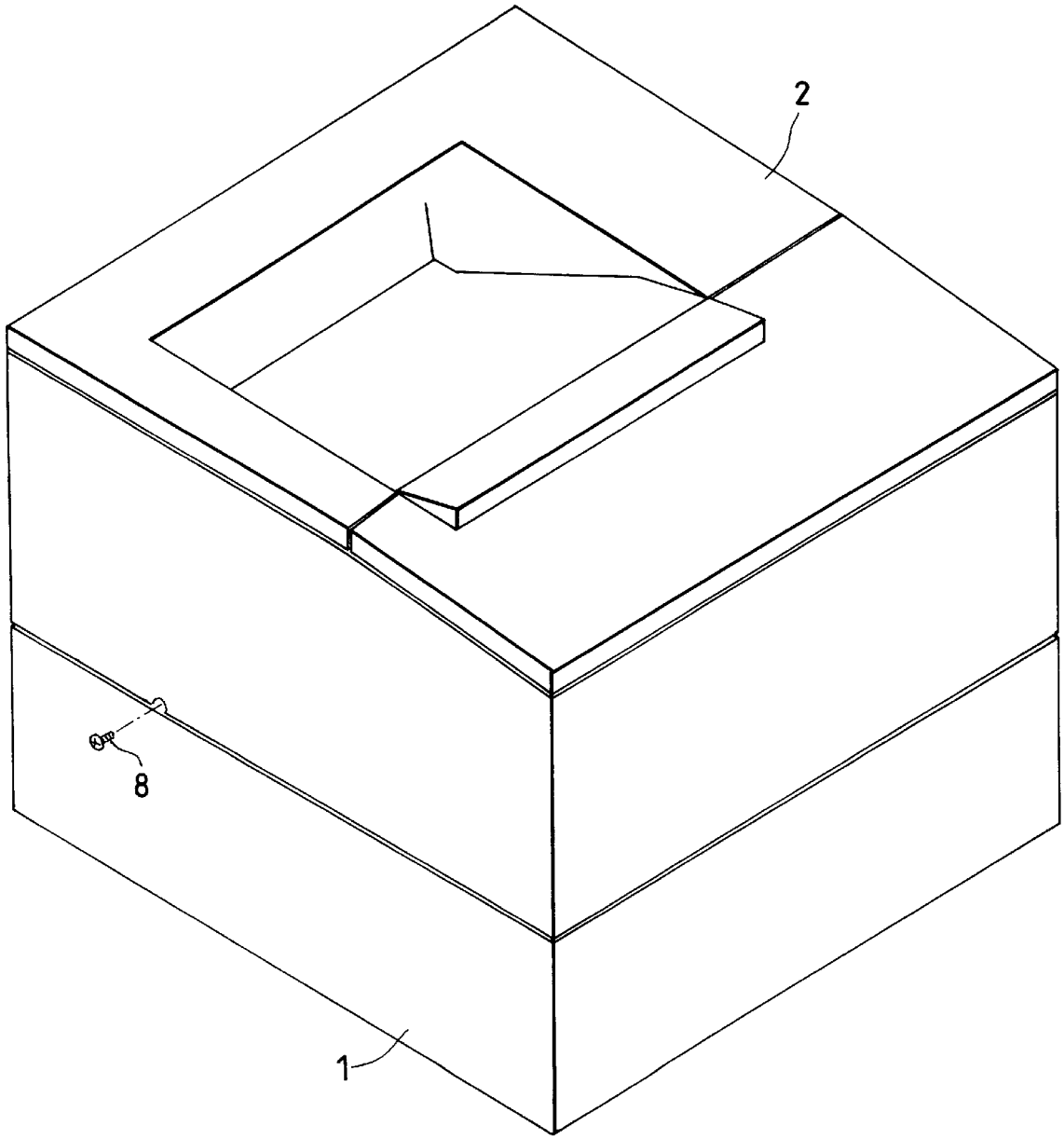
FIG. 3 is a perspective view of the laser beam printer having the module connecting mechanism according to the present invention.
Figure 4:
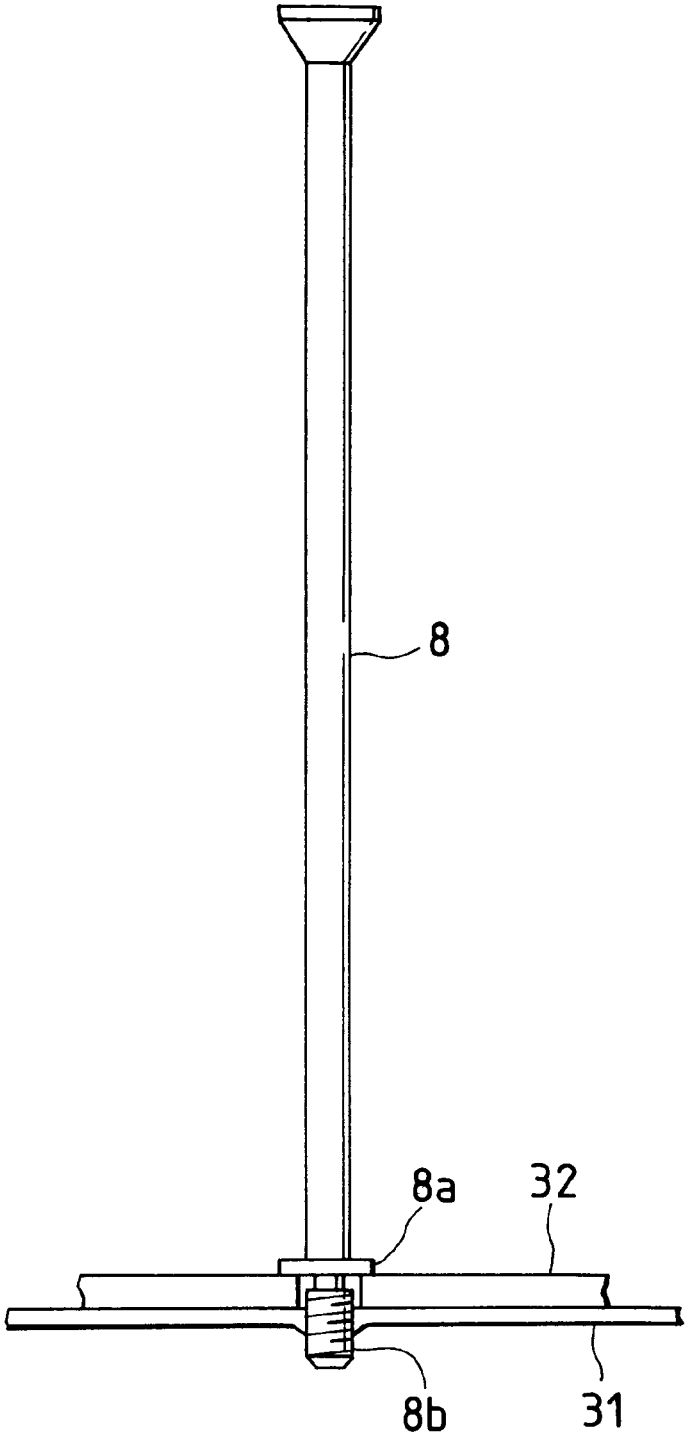
FIG. 4 is an expanded detail sectional view of a connecting section between an engine module and a supplying module in the laser beam printer having the module connecting mechanism according to the present invention.

As screws used for fitting the engine module 2 and the supplying module 1, there are screws 8 to be tightened in a state that an opening-closing cover 11 is opened and a screw 7 shown in FIGS. 3 and 4 besides the screws for the connecting sheet metal 4. As the screws 8, taking into consideration assembly effects, each has a length that the upper end of the screw is placed in a position 100 mm or shorter apart from the top of the engine module 2 which is accessible. By using long screws 8 like this, workability of assembling or disassembling is increased.

On the other hand, as shown in FIG. 4, a flange portion 8*a* is formed adjacent to a tip of the screw, which is a thread formation section 8*b* in the screw 8, so that the engine module 2 is connected to the supplying module 1 with the thread formation section 8*b* engaging a female screw formed on a member 31 in the supplying module 1 and with the flange portion 8*a* holding a frame member 32 of the engine module 2. Since the connection is completed only at the tip of the long screw in this manner, it is possible to prevent a fatigue of the screw caused by twisting of a rod portion which is a fear for a screw having a flange in an upper position and to prevent an occurrence of looseness of the screw caused by such a fatigue.

After completion of connecting the engine module 2 to the supplying module 1, the shield cover 9 is fitted for covering the shield case 6. The shield case unit attached in a form of a box further enhances reinforcement of the connection of the engine module 2 and the supplying module 1.

Accordingly, with application of the above configuration, this device can satisfy not only demands of the market for diversification related to a supplying configuration, but also those of the market related to the image controller board 5. Additionally, with an application of the above screw configuration, the engine module 2 can be connected to the supplying module 1 without removing exterior fitting members.

As set fourth hereinabove, according to the present invention, in a module connecting mechanism of an electrophotographic apparatus for connecting a supplying module to an engine module by superposing the engine module having an electrophotographic process portion used for forming an image on a supplied sheet and fixing it on the supplying module for separating and supplying stacked sheets sequentially, a common plane is made by the supplying module and the engine module almost in parallel with the direction of connecting the supplying module to the engine module and then a fastening member is put across the connection of the supplying module and the engine module on the common plane, by which the supplying module is connected at least partially to the engine module. Therefore, there is an effect of reinforcing the connection of the supplying module and the engine module and of ensuring a relative position of the both modules.

What is claimed is:

1. An electrophotographic apparatus, comprising:

an engine module having an engine portion using an electrophotographic system;

a supplying module for holding a sheet stack portion for stacking sheets and connected to said engine module to supply a sheet from the sheet stack portion to said engine module; and a fixing member for fixing a positional relationship between said engine module and said supplying module, wherein said fixing member bestrides over respective planes of said engine module and said supplying module to connect said engine module with said supplying module, said planes being substantially parallel to a direction of connecting said engine module with said supplying module.

2. An electrophotographic apparatus according to claim 1, wherein said fixing member is attached to sides of said engine module and said supplying module, with said modules being disposed on top of each other.

3. An electrophotographic apparatus according to claim 2, further comprising:

a connecting member for directly connecting said engine module with said supplying module.

4. An electrophotographic apparatus according to claim 1, wherein said fixing member is made of metal and serves as an earthed path for said engine module and said supplying module.

5. An electrophotographic apparatus according to claim 1, further comprising a shield box, forming part of said fixing member, for shielding an electric equipment substrate installed therein.

6. An electrophotographic apparatus according to claim 5, wherein said engine module and said supplying module are formed with recessed portions, and said shield box is disposed in a space defined by said recessed portions.

7. An electrophotographic apparatus according to claim 1, wherein said respective substantial planes of said engine module and said supplying module, while being substantially parallel to the direction of connecting said engine module with said supplying module, are substantially coplanar.

* * * * *

UNITED STATES PATENT AND TRADEMARK OFFICE

CERTIFICATE OF CORRECTION

PATENT NO. : 5,950,046

DATED : September 7, 1999

INVENTOR(S): SHINJI GOTO

It is certified that error appears in the above-identified patent and that said Letters Patent is hereby corrected as shown below:

COLUMN 1:

Line 13, "system," should read --system.--.

Signed and Sealed this

Nineteenth Day of September, 2000

*Attest:*

Q. TODD DICKINSON

*Attesting Officer*

*Director of Patents and Trademarks*